US007165691B2

(12) United States Patent
Kimura

(10) Patent No.: US 7,165,691 B2
(45) Date of Patent: Jan. 23, 2007

(54) COUNTERWEIGHT ATTACHING AND DETACHING APPARATUS FOR CRANE

(75) Inventor: Hiroshi Kimura, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 4 days.

(21) Appl. No.: 11/193,476

(22) Filed: Aug. 1, 2005

(65) Prior Publication Data

US 2006/0043042 A1 Mar. 2, 2006

(30) Foreign Application Priority Data

Aug. 25, 2004 (JP) ..... 2004-245000

(51) Int. Cl.
*B66C 23/72* (2006.01)

(52) U.S. Cl. ..... 212/178; 212/195

(58) Field of Classification Search ..... 212/178, 212/195, 196

See application file for complete search history.

(56) References Cited

U.S. PATENT DOCUMENTS

| | | |
|---|---|---|
| 2005/0098522 A1 | 5/2005 | Mizuta et al. |
| 2005/0098523 A1 | 5/2005 | Mizuta et al. |

FOREIGN PATENT DOCUMENTS

| | | |
|---|---|---|
| JP | 6-16388 | 1/1994 |
| JP | 2542385 | 4/1997 |
| JP | 9-71390 | * 9/1997 |
| JP | 10-45385 | * 10/1998 |

OTHER PUBLICATIONS

Patent Abstracts of Japan, JP 11-158927, Jun. 15, 1999.

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

In a counterweight attaching and detaching apparatus for a crane, the length of a suspension member is adjusted by an extendable member and links because the distance provided between the peak of a gantry and an upper surface of each of weights when the gantry is suspending the weight at a respective mounting position varies depending on the mounting position. In order to complement the adjustment of the length, different amounts of protrusion of rings from the upper surfaces of the weights are set so that the protrusion amount in the forefront weight is the largest and the protrusion amount in the rearmost weight is the smallest. This reduces the number of types of necessary links used in the suspension member to attach and detach the weights, and the number of operations of connecting and removing the links, and improves operation efficiency.

4 Claims, 9 Drawing Sheets

COUNTERWEIGHT ATTACHING AND DETACHING APPARATUS FOR CRANE

BACKGROUND OF THE INVENTION

1. Field of the Invention

The present invention relates to a counterweight attaching and detaching apparatus for a crane that attaches and detaches a counterweight to and from an upper rotating body by itself.

2. Description of the Related Art

A large crawler crane is difficult to transport. Therefore, the crawler crane is disassembled into a plurality of blocks, and the blocks are transported by a trailer, and are assembled into the crane at a worksite. The crawler crane attaches and detaches a counterweight by itself by using a boom raising device when other cranes are unavailable.

A counterweight attaching and detaching apparatus and a method using the apparatus disclosed in the related art will be described, with reference to FIGS. 7 to 10, for comparison with the present invention.

The distance L between the peak of a gantry 11 suspending weights 5 to 8, and the upper surfaces of the weights 5 to 8 shown in FIG. 8 (hereinafter sometimes referred to as a "peak-to-weight distance") varies depending on the positions of the weights 5 to 8 in the front-rear direction. Therefore, there is a need to adjust the length of a suspension member 15 in accordance with the variation.

In this case, since the length cannot be sufficiently adjusted only by extension and contraction of a hydraulic cylinder 16, it is also adjusted by selectively using a link 18, a link 19, and a link 20.

The adjustment will now be described more specifically:

(i) When the first weight 5 that has the longest distance L is attached or detached, all the links 18 to 20 are connected in series to make the length of the suspension member 15 the largest (the left state in FIG. 9).

(ii) When the second and third weights 6 and 7 are attached or detached, the link 18 is removed, and the other links 19 and 20 are used (the right state in FIG. 9 and the left state in FIG. 10). In this case, the difference in length L between the weights 6 and 7 is overcome by extension and contraction of the hydraulic cylinder 16.

(iii) When the fourth weight 8 that has the shortest distance L is attached or detached, the link 20 is removed, and only the link 19 is used to make the length of the suspension member 15 the smallest (the right state in FIG. 10).

The lower end of the suspension member 15 is fastened to any of rings 21 to 24 protruding from the upper surfaces of the weights 5 to 8, and the weights 5 to 8 are moved up and down between the ground and the mounting positions by raising and lowering the gantry 11.

The amounts A of protrusion of the rings 21 to 24 (represented by the amount of protrusion of the centers of holes for a pin that fastens the lower end of the suspension member 15 in FIG. 8) of the weights 5 to 8 are equally set. Since the length of the suspension member 15 is adjusted only by the links 18 to 20 in order to cope with the variation of the peak-to-weight distance L, the links 18 to 20 need to be selectively used correspondingly to the weights 5 to 8.

That is, the long and heavy links 18 and 20 must be removed or connected during three operations of attaching or detaching the weight 5, the weights 6 and 7, and the weight 8, and the operations are interrupted. Therefore, the operation efficiency is seriously decreased.

It is conceivable to adjust the length only by a long hydraulic cylinder without using a link, as disclosed in Japanese Registered Utility Model No. 2542385. However, except when the counterweight is attached or detached, the long cylinder is obstructive (for example, it must be shifted when folding the gantry). This is a practical problem.

Although it is also conceivable to use a multiple stroke cylinder that shortens to a small size, this is disadvantageous in cost.

SUMMARY OF THE INVENTION

Accordingly, it is an object of the present invention to provide a counterweight attaching and detaching apparatus for a crane that uses a suspension member including an extendable member and links, and that can reduce the number of types of necessary links, that is, the number of attaching and detaching operations of the links for weights while ensuring a function of adjusting the required length of the suspension member.

A counterweight attaching and detaching apparatus according to an aspect of the present invention includes a lower traveling body; an upper rotating body rotatably mounted on the lower traveling body; a gantry serving as a boom raising device provided in the rear of the upper rotating body to be movable up and down; a suspension member hanging from the peak of the gantry; a plurality of weights arranged in the front-rear direction of the counterweight attaching and detaching apparatus to constitute a counterweight placed in a vertical position, and each of the weights respectively having a ring to which the suspension member is fastened; and a mechanism that sequentially attaches or detaches the weights to or from a rear end of the upper rotating body by moving the gantry up and down while the suspension member is sequentially fastened to the ring of each of the weights. The suspension member includes an extendable member that extends and contracts to vertically move the weights, and a link detachably connected to the extendable member. The distance provided between the peak of the gantry and the upper surface of each of the weights when the gantry is suspending each of the weights at a respective mounting position varies depending on the mounting position, and the length of the suspension member is adjusted by the extendable member and the link in accordance with the distance. At least three different amounts of protrusion of the rings from the upper surfaces of the weights are set so that the amount of protrusion of the ring of the forefront weight close to the upper rotating body is the largest and so that the amount of protrusion of the ring of the rearmost weight is the smallest in order to complement the adjustment of the length of the suspension member.

According to the present invention, the amounts of protrusion of the rings for the weights are made different, and the rings are added as elements for adjusting the length of the suspension member. Therefore, the number of types of necessary links can be reduced while ensuring the required length adjusting function.

Consequently, it is possible to reduce the number of operations of connecting or removing the links performed in one operation of attaching or detaching the counterweight (for example, two operations in the related art using four weights is reduced to one operation). For this reason, the operation efficiency is improved, and the operation time is shortened.

DESCRIPTION OF THE PREFERRED EMBODIMENTS

Figure 1:
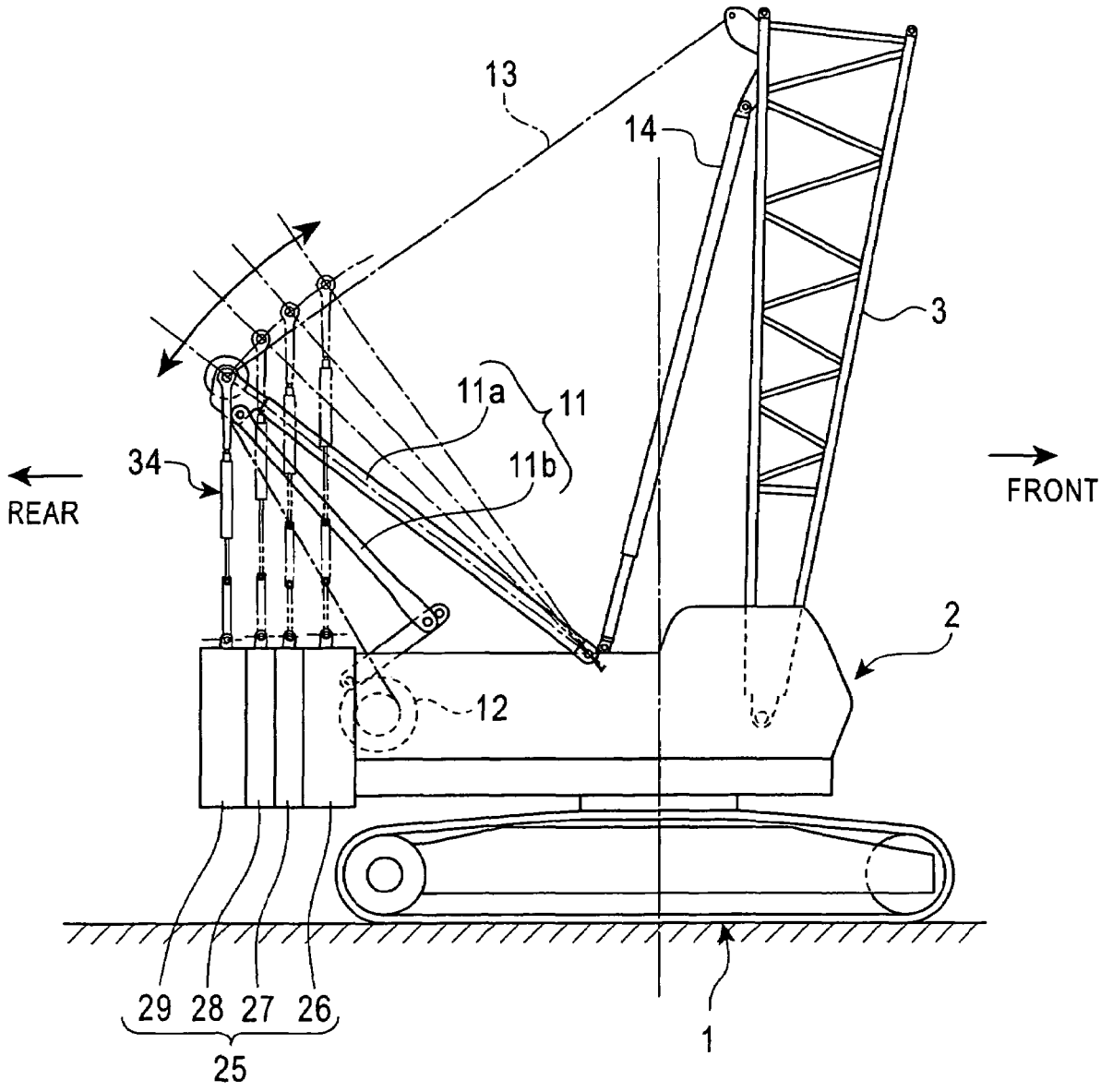
FIG. 1 is a side view of a counterweight attaching and detaching apparatus according to an embodiment of the present invention.

A crawler crane according to a preferred embodiment of the present invention will be described with reference to FIGS. 1 to 6.

In the following description of the embodiment, the same components as those in the related art shown in FIGS. 7 to 10 are denoted by the same reference numerals.

Referring to FIG. 1, a crawler crane of this embodiment includes a lower traveling body 1 like a crawler, and an upper rotating body 2 mounted on the lower traveling body 1 so as to rotate on the vertical axis (rotation axis). A movable boom 3 is mounted at the front of the upper rotating body 2 (a lower part of the boom is left when attaching and detaching the counterweight, as shown in the figure), and a counterweight 25 is mounted at the rear end thereof.

In this embodiment, the counterweight 25 is mounted in a vertical position, and includes a plurality of (four in this embodiment) weights 26, 27, 28, and 29 arranged in the front-rear direction. The weights 26, 27, 28, and 29 are sequentially attached from the forefront one to assemble the counterweight 25, and are sequentially detached from the rearmost one to disassemble the counterweight 25. Hereinafter, the weights are referred to as first, second, third, and fourth weights from the forefront side. That is, the first, second, third, and fourth weights respectively correspond to the weights 26, 27, 28, and 29.

Figure 2:
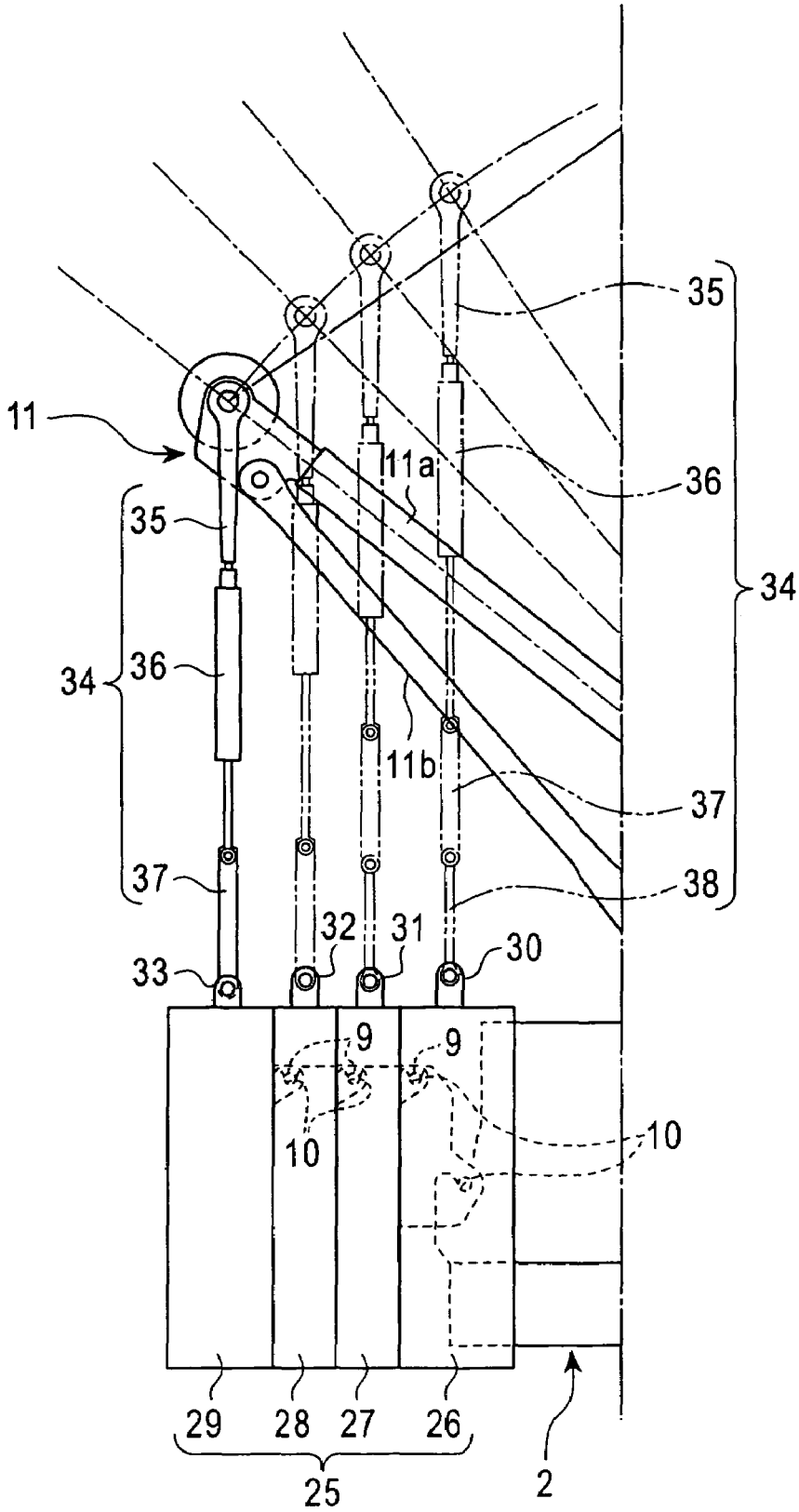
FIG. 2 is an enlarged view of a part of the counterweight attaching and detaching apparatus shown in FIG. 1.
Figure 3:
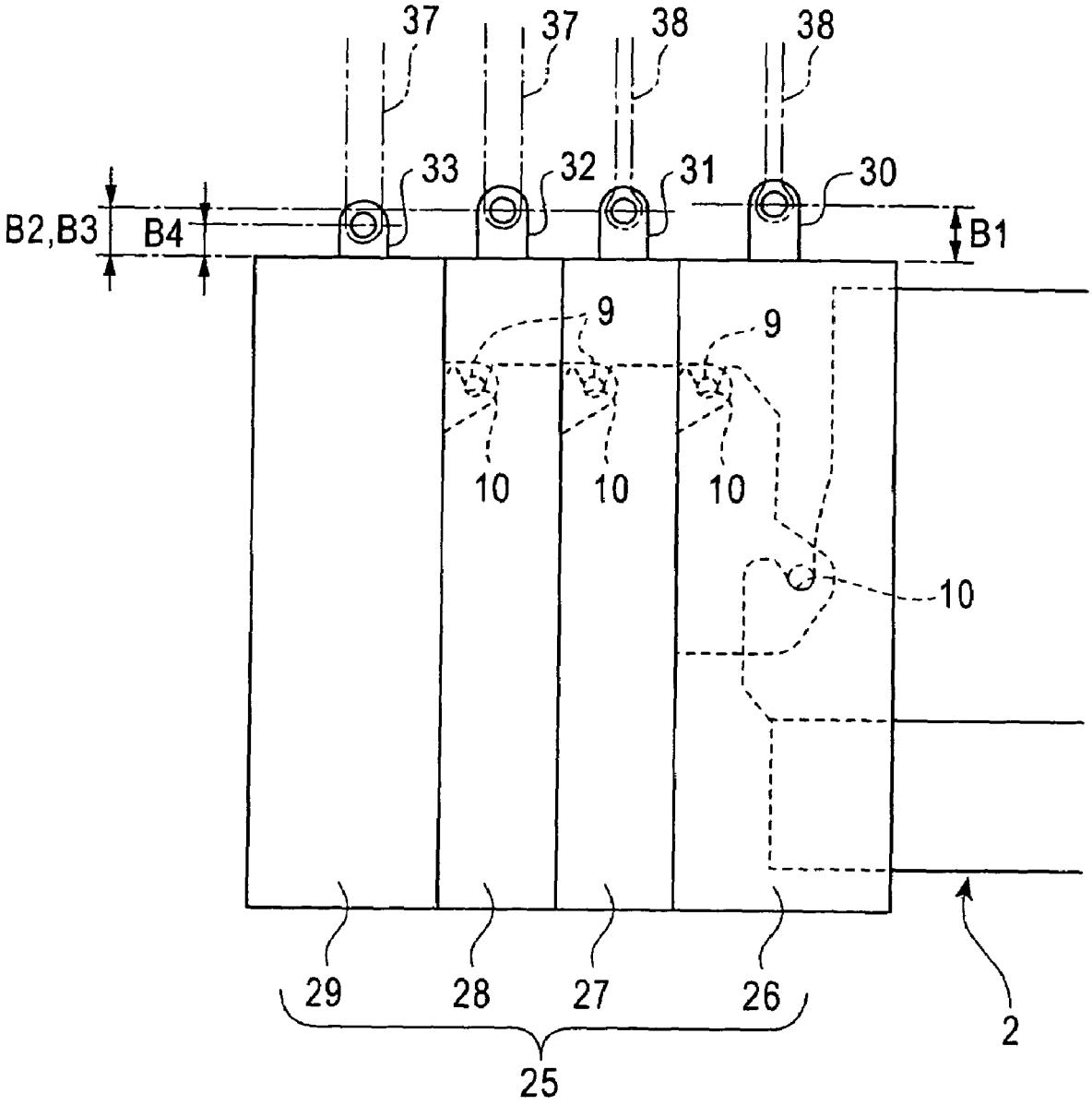
FIG. 3 is a further enlarged view of the part shown in FIG. 2.

Each of the weights 26 to 29 is provided with a retaining portion 9 that is shaped like a shaft horizontally extending in the front-right direction, as shown in FIG. 2. The retaining portion 9 functions as a means for mounting the corresponding weight.

Upwardly opened receiving portions 10 are provided at the rear end face of the upper rotating body 2 and on the rear sides of the first to third weights 26, 27, and 28. The retaining portions 9 are fitted in the corresponding receiving portions 10 from above to form a hook structure. Consequently, the first weight 26 is attached to the upper rotating body 2, and the second to fourth weights 27 to 29 are attached to the corresponding weights disposed in front thereof.

Because of this hook structure, the weights 26 to 29 are attached by being vertically lowered from the mounting positions (in the front-rear direction) where they hang, and are detached by being vertically raised from the mounting positions.

After attached, the weights 26 to 29 are fixed together to the upper rotating body 2 by a bolt (not shown) that extends in the front-rear direction through the weights.

A boom-raising gantry 11 having front and rear members 11*a* and 11*b* arranged in an inverse V-shape is provided on the upper rotating body 2. When attaching or detaching the counterweight 25, a boom-raising rope 13 drawn out of a boom-raising winch 12 is fastened to the boom 3 through the gantry 11.

When the boom-raising winch 12 is driven with the boom 3 fixed by a back stop 14, the gantry 11 pivots on the lower end of the front member 11*a*.

A suspension member 34 hangs from the peak of the gantry 11 (gantry peak) as a means for suspending the weights 26 to 29 from the gantry 11. While the suspension member 34 is provided on each of the right and left sides of the widthwise center of the gantry 11, a suspension member 34 only on one side is shown in the figures.

The suspension member 34 includes a hydraulic cylinder 36 serving as an extendable member, a cylinder mounting member 35 for mounting a head side (upper side) of the hydraulic cylinder 36 at the gantry peak, and first and second links 37 and 38 mounted at a rod side (lower side) of the hydraulic cylinder 36.

The first and second links 37 and 38 are used in different combinations depending on the weights 26 to 29 to be attached and detached.

First, second, third, and fourth rings 30, 31, 32, and 33 respectively protrude upward from the upper surfaces of the weights 26 to 29.

The amounts B1 to B4 of protrusion of the rings 30 to 33 from the upper surfaces of the weights 26 to 29 (see FIG. 3) are set so that the amount B1 of the first ring 30 is the largest, the amount B4 of the fourth ring 33 is the smallest, and the amounts B2 and B3 of the second and third rings 31 and 32 are equal between the amounts B1 and B4.

As shown in FIG. 2, the suspension member 34 for suspending the weights 26 to 29 includes the extendable hydraulic cylinder 36 with the cylinder mounting member 35, and the first and second links 37 and 38 that are used singly or in combination.

Figure 4:
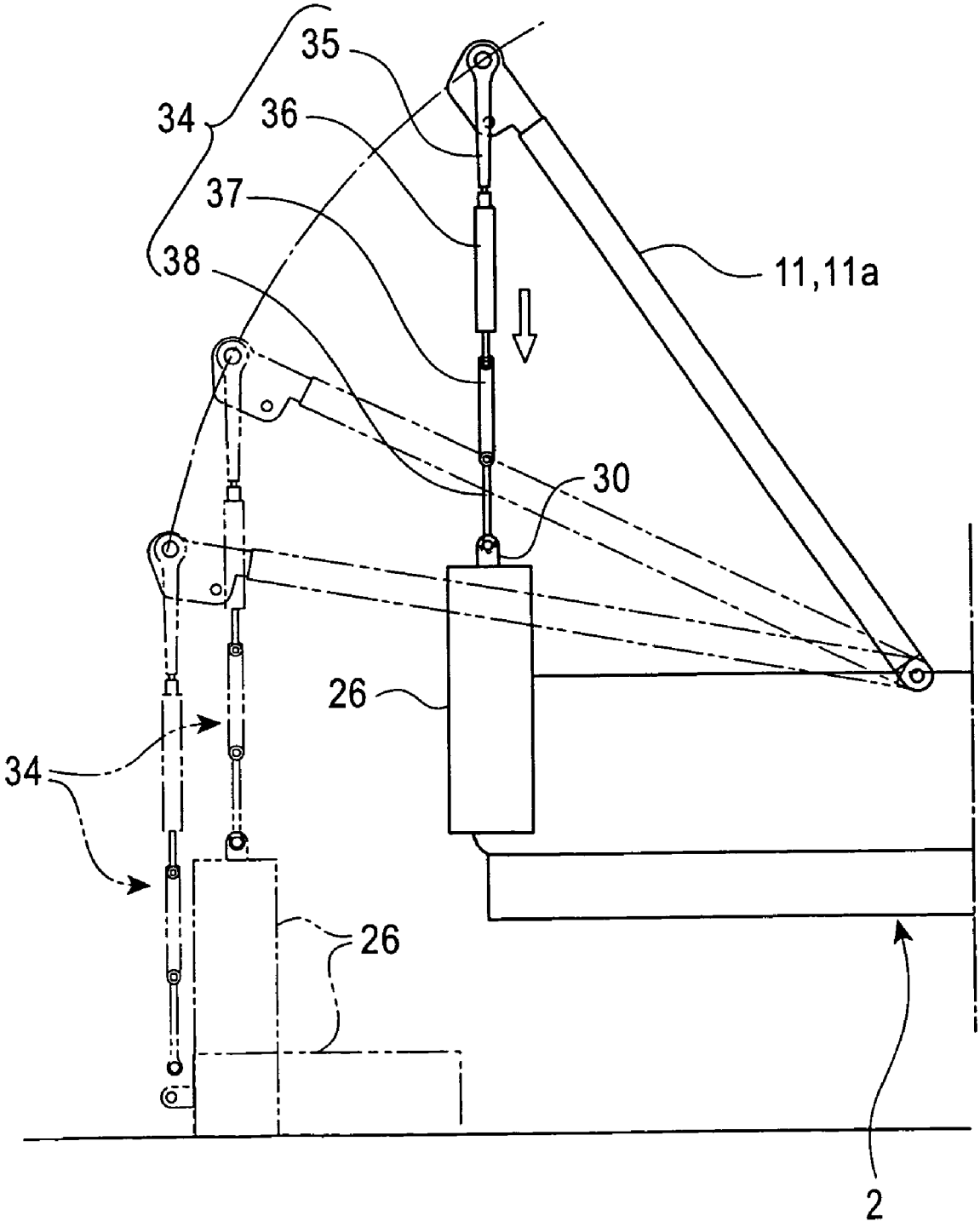
FIG. 4 is a side view showing a mounting state of a first weight that constitutes a counterweight.

That is, in order to attach the first weight 26, the first and second links 37 and 38 are connected in series to the lower end of the hydraulic cylinder 36 hanging from the gantry peak with the cylinder mounting member 35 disposed therebetween, thus forming the suspension member 34, as shown in FIGS. 2 and 4. The lower end of the suspension member 34 is fastened to the ring 30 of the first weight 26.

Figure 5:
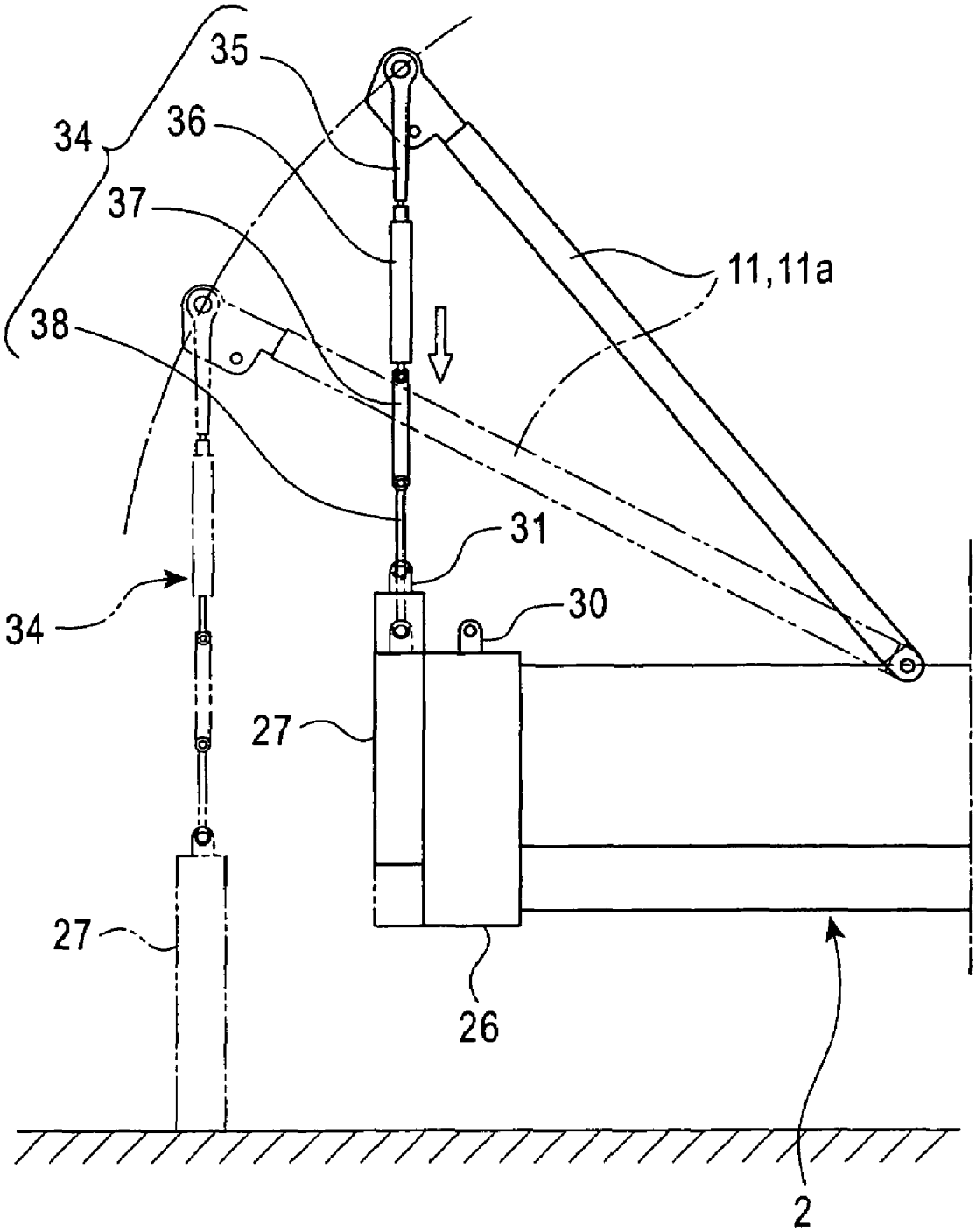
FIG. 5 is a side view showing a mounting state of a second weight that constitutes a counterweight.
Figure 6:
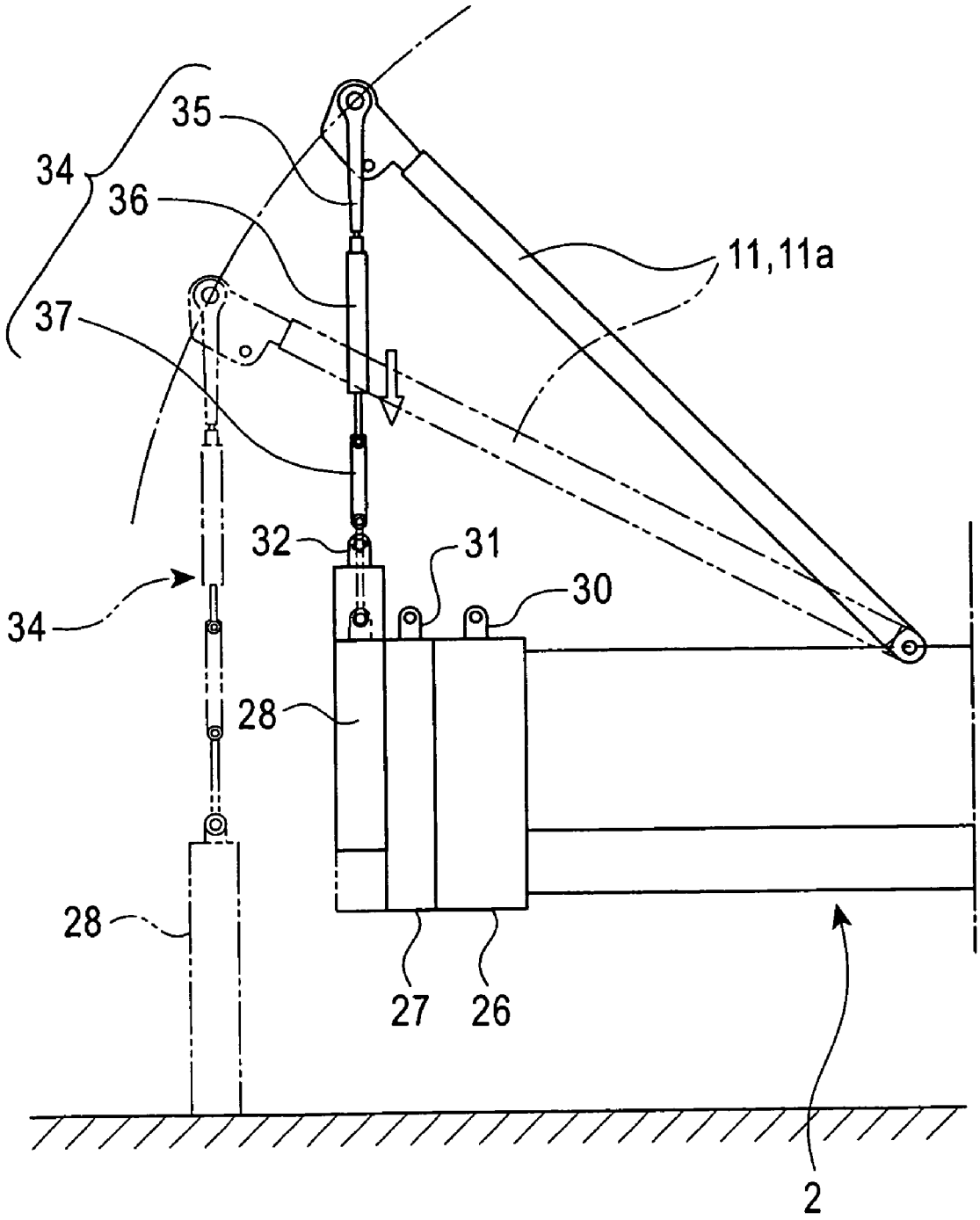
FIG. 6 is a side view showing a mounting state of a third weight that constitutes a counterweight.

In this state, the first weight 26 is attached to the upper rotating body 2 by an upward and downward movement of the gantry 11 shown in FIG. 1 (only the front member 11*a* is shown in FIGS. 4 to 6) and extension and contraction of the hydraulic cylinder 36.

Subsequently, the second weight 27 is attached to the rear surface of the first weight 26 by the suspension member 34 placed in the same state as during attachment of the first weight 26, as shown in FIGS. 2 and 5.

In this case, the required length of the suspension member 34 is smaller than that for the first weight 26. However, this difference is overcome by contraction of the hydraulic cylinder 36 and the difference between the amounts B1 and B2 of protrusion of the rings 30 and 31.

In other words, the amounts B1 and B2 of protrusion of the rings 30 and 31 of the first and second weights 26 and 27 are determined so that the difference of the required length of the suspension member 34 between the first and second weights 26 and 27 can be overcome by contraction of the hydraulic cylinder 36 and the difference between the amounts B1 and B2.

In order to attach the third and fourth weights 28 and 29, the second link 38 is removed from the first link 37 to reduce the total length of the suspension member 34, as shown in FIGS. 2 and 6. In this state, the third and fourth weights 28 and 29 are sequentially attached to the rear surface of the corresponding weight (second weight 27 or third weight 28) disposed in front thereof.

During attachment of the third and fourth weights 28 and 29, the total length of the suspension member 34 is also adjusted by extension and contraction of the hydraulic cylinder 36. The difference in the required length of the suspension members 34 is overcome by the sum of the amount of adjustment by the hydraulic cylinder 36, and the difference between the amounts B3 and B4 of protrusion of the rings 32 and 33.

To detach the counterweight 25, the attachment procedure is reversed.

In this way, in the counterweight attaching and detaching apparatus, the amounts B1 to B4 of protrusion of the rings 30 to 33 of the weights 26 to 29 are different, and the rings 30 to 33 are added as elements (substantial links) for adjusting the length of the suspension member 34. For this reason, the required links can be limited to the two first and second links 37 and 38 while ensuring the required length adjusting function.

Figure 7:
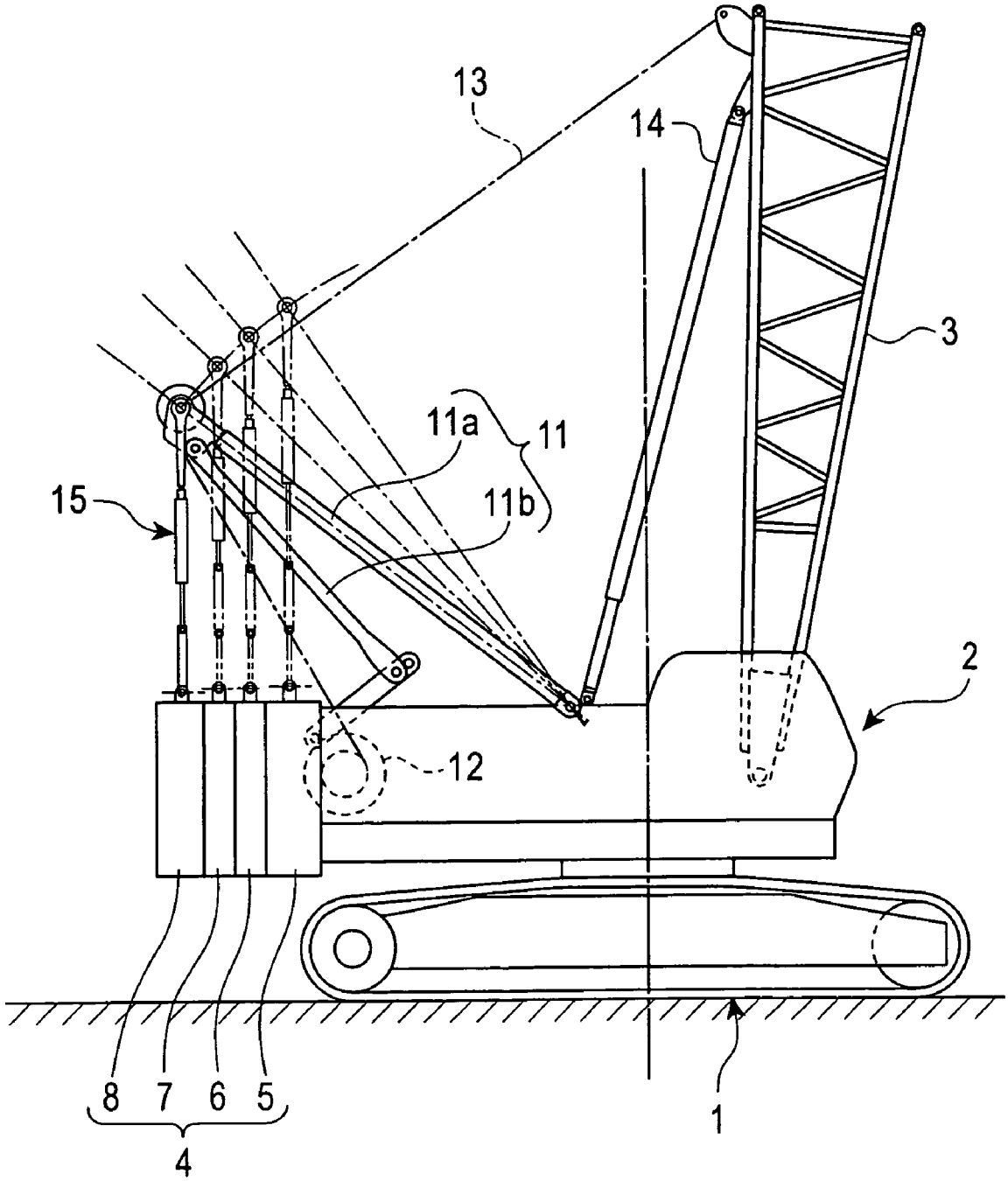
FIG. 7 is a side view of a counterweight attaching and detaching apparatus as the related art.
Figure 8:
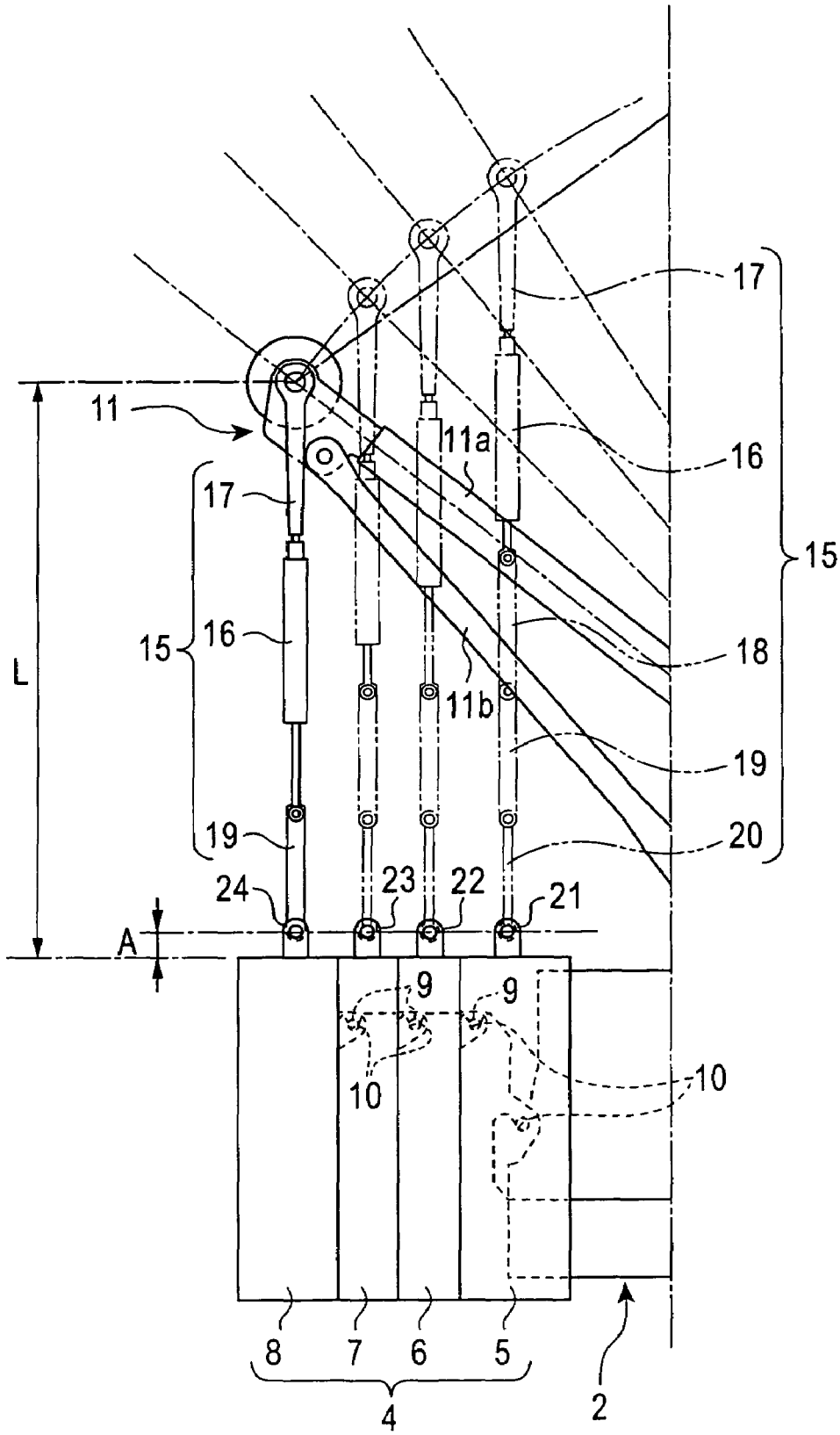
FIG. 8 is a partly enlarged view of the counterweight attaching and detaching apparatus shown in FIG. 7.
Figure 9:
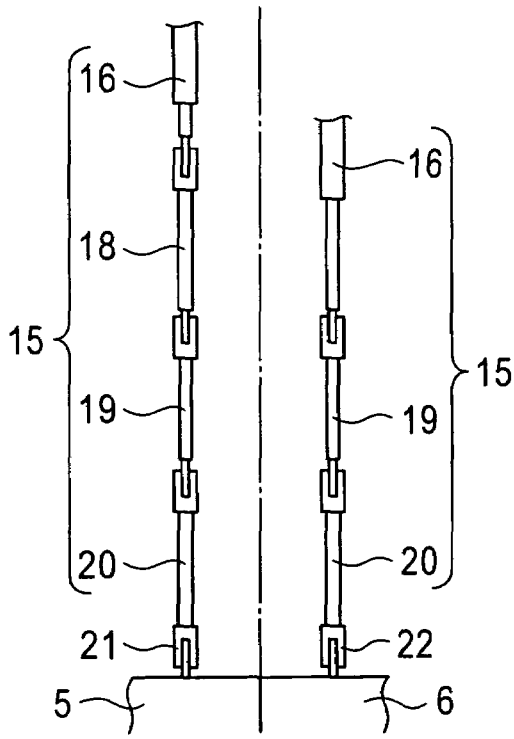
FIG. 9 is a rear view showing mounting states of first and second weights of a counterweight in the related art, respectively, on right and left sides.
Figure 10:
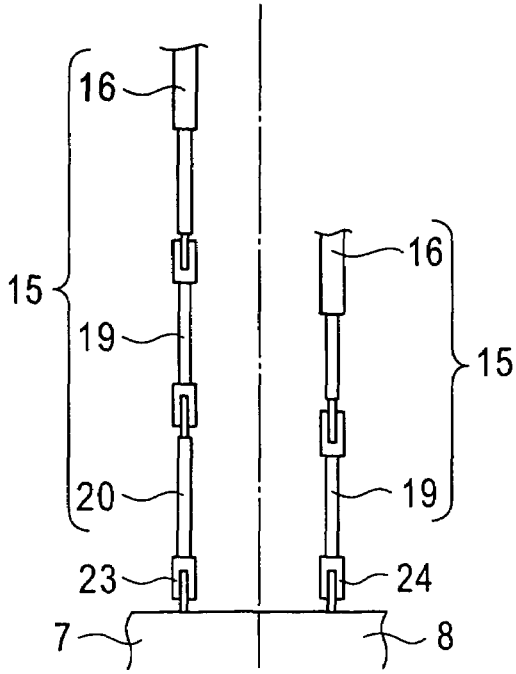
FIG. 10 is a rear view showing mounting states of third and fourth weights of the counterweight in the related art, respectively, on right and left sides.

As a result, the number of operations of connecting or removing the links that are performed to attach or detach the counterweight 25 can be reduced to be half the number in the related art using the counterweight 4 having the same structure shown in FIGS. 7 and 8.

Accordingly, it is possible to substantially enhance the efficiency of the counterweight attaching and detaching operation, and to thereby reduce the operation time.

The amounts B2 and B3 of protrusion of the rings 31 and 32 for the second and third intermediate weights 27 and 28 are set equal in view of the fact that the difference in the required length of the suspension member 34 between the weights 27 and 28 is small, and can be overcome only by the extension and contraction of the hydraulic cylinder 36. This allows the second and third weights 27 and 28 to have the same structure.

For this reason, the production cost can be reduced, compared with the case in which the amounts of protrusion of the rings of the weights 26 to 29 are different from one another.

OTHER EMBODIMENTS (1) While the above embodiment is applied to a crane in which the weights 26 to 29 are turned and moved up and down by raising and lowering the gantry 11 by the boom-raising winch 12 and the boom-raising rope 13, the present invention is also applicable to a crane in which a gantry is raised and lowered by a hydraulic cylinder (gantry cylinder).

(2) While the counterweight 25 includes four weights 26 to 29 in the above embodiment, the present invention is also applicable to a case in which the counterweight includes five or more weights.

In this case, the required number of links is larger than in the above embodiment. However, the number can be made smaller than in the related art by changing the amounts of protrusion of the rings.

(3) While the hydraulic cylinder 36 is used as the extendable member that extends and contracts to vertically move the weights in the above embodiment, it may be replaced with an extendable member, such as a screw cylinder, which is extended and contracted by a hydraulic motor or an electric motor.

Although the invention has been described with reference to the preferred embodiments in the attached figures, it is noted that equivalents may be employed and substitutions made herein without departing from the scope of the invention as recited in the claims.

What is claimed is:

1. A counterweight attaching and detaching apparatus for a crane, the apparatus comprising:

a lower traveling body;

an upper rotating body rotatably mounted on the lower traveling body;

a gantry serving as a boom raising device provided in the rear of the upper rotating body to be movable up and down;

a suspension member hanging from the peak of the gantry;

a plurality of weights arranged in the front-rear direction to constitute a counterweight placed in a vertical position, and each of the weights respectively having a ring to which the suspension member is fastened; and a mechanism that sequentially attaches or detaches the weights to or from a rear end of the upper rotating body by moving the gantry up and down while the suspension member is sequentially fastened to the ring of each of the weights, wherein the suspension member includes an extendable member that extends and contracts to vertically move the weights, and a link detachably connected to the extendable member, wherein the distance provided between the peak of the gantry and the upper surface of each of the weights when the gantry is suspending each of the weights at a respective mounting position varies depending on the mounting position, and the length of the suspension member is adjusted by the extendable member and the link in accordance with the distance, and wherein at least three different amounts of protrusion of the rings from the upper surfaces of the weights are set so that the amount of protrusion of the ring of the forefront weight close to the upper rotating body is the largest and so that the amount of protrusion of the ring of the rearmost weight is the smallest in order to complement the adjustment of the length of the suspension member.

2. The counterweight attaching and detaching apparatus according to claim 1, wherein the extendable member is extended and contracted by a hydraulic cylinder.

3. The counterweight attaching and detaching apparatus according to claim 1, wherein each of the weights respectively has a retaining portion, the retaining portion of the forefront weight is fitted in a receiving portion of the upper rotating body from above, and the retaining portions of the weights other than the forefront weight are fitted in receiving portions respectively provided in the corresponding weights from above.

4. The counterweight attaching and detaching apparatus according to claim 1, wherein the amounts of protrusion of the rings of weights disposed between the forefront and rearmost weights are equally set.

* * * * *